United States Patent [19]

Head

[11] 4,402,513

[45] Sep. 6, 1983

[54] WORD CARD GAME

[76] Inventor: Robert M. Head, 4140 S 400 West, Apt. 104, Granger, Utah 84119

[21] Appl. No.: 373,352

[22] Filed: Apr. 30, 1982

[51] Int. Cl.[3] ..... A63F 1/04

[52] U.S. Cl. ..... 273/296; 273/299; 434/172

[58] Field of Search ..... 273/296, 299, 272; 434/172

[56] References Cited

U.S. PATENT DOCUMENTS

| | | | |
|---|---|---|---|
| 1,076,307 | 10/1913 | Nicholson | 273/299 |
| 1,312,278 | 8/1919 | Shinn | 273/299 |
| 1,485,146 | 2/1924 | Mundell | 273/296 |
| 1,551,680 | 9/1925 | Meissner | 273/299 |
| 2,000,812 | 5/1935 | Adams | 273/299 |

*Primary Examiner*—Anton O. Oechsle

*Attorney, Agent, or Firm*—Terry M. Crellin; B. Deon Criddle

[57] ABSTRACT

A spelling, counting and memory game is disclosed in which a word card is provided having a word printed on the reverse face thereof and a numerical representation of that word on the obverse side thereof. A plurality of playing cards are provided having indicia printed thereon. The indicia can either be letters of the alphabet or numbers representing letters of the alphabet. The playing cards are played from the players' hands in a pile in the order revealed on the word card.

4 Claims, 4 Drawing Figures

WORD CARD GAME

BACKGROUND OF THE INVENTION

1. Field:

This invention relates to card games involving spelling, counting and memory. The invention particularly relates to a novel card game in which a word is spelled by deciphering a numerical representation of the word, with memory being used to recall the word spelled, or the game may involve forming the numerical representation from a word, with memory of the numbers being used to recall the numerical representation.

2. State of the Art:

Word games utilizing playing cards have been proposed in the prior art. Such games may involve the use of letter indicia on the cards to form either predetermined words (see for example U.S. Pat. No. 977,117) or to allow the player to form his own words (see U.S. Pat. No. 2,265,334). Other examples of word games using playing cards are shown in U.S. Pat. Nos. 1,076,307; 1,312,278; 1,551,680; 2,783,998, and 4,219,197.

None of the games disclosed in the prior art, however, utilize two sets of cards in which one set include word cards in which numerical representations of the words are printed on the obverse faces of the cards, with the correctly spelled word being printed on the reverse faces of the mutually respective cards. The games of the prior art do not involve deciphering of a numerical representation of the word in letter by letter fashion, with memory of the letters and numbers being used to either spell the word or recall the numerical representation of the word.

OBJECTIVE

It is a principal objective of the present invention to provide an interesting, stimulating, educational card game involving spelling, counting, deciphering and memory.

SUMMARY OF THE INVENTION

In accordance with the present invention, the above objective is achieved by providing a card game involving spelling, counting, deciphering and exercise of memory by those playing the game. In the present invention, there is provided at least one word card and preferably, a plurality of such word cards as to form a deck of word cards. Each word card has a word imprinted on the reverse face thereof and a numerical representation of the same word imprinted on the obverse face thereof. The word which is imprinted on any particular word card is different and distinct from the words on the other word cards. The numerical representation on the obverse face of each word card is formed by a set of numbers in which each number represents a particular letter of the alphabet as determined by the numerical arrangement of the letters in the alphabet.

In addition to the word cards, a plurality of playing cards are provided in which indicia corresponding to the letters of the alphabet or to numbers representing letters of the alphabet are printed on the playing cards. The playing cards are imprinted so that each playing card has a single letter of the alphabet printed thereon or a number representing the letter of the alphabet printed thereon. Thus, each playing card represents a single letter of the alphabet. Sufficient playing cards are provided so that words on the word cards can be spelled out using the playing cards. Preferably, there are at least 52 playing cards comprising a pair of cards for each letter of the alphabet, so that words can be used on the word cards which have double letters therein.

Other objects and features of the invention, including a description of the play of the game, will be described in the following detailed description taken together with the accompanying drawings.

THE DRAWINGS

Preferred embodiments of the present invention representing the best mode presently contemplated of carrying out the invention is illustrated in the accompanying drawings, in which.

DETAILED DESCRIPTION OF THE INVENTION

Figure 1:
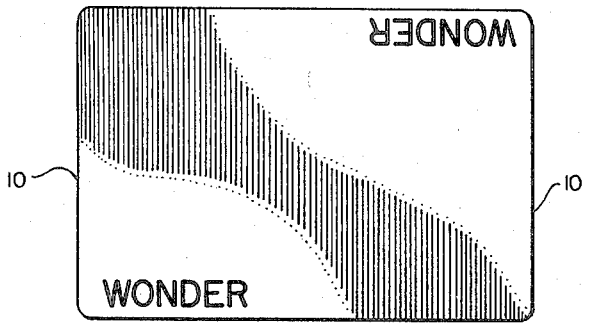
FIG. 1 is a view of the reverse face of one of the word cards from the word card deck with the word "WONDER" imprinted thereon.

In a preferred embodiment of the invention, there is provided a deck of word cards comprising any number of word cards, each card representing a distinct word. In FIG. 1 there is shown a representative word card 10 from the deck of word cards. The cards of this invention, both the word cards and playing cards, are preferably made of plastic, plastic coated paper, or other playing card material as used in standard sets of playing cards.

Figure 2:
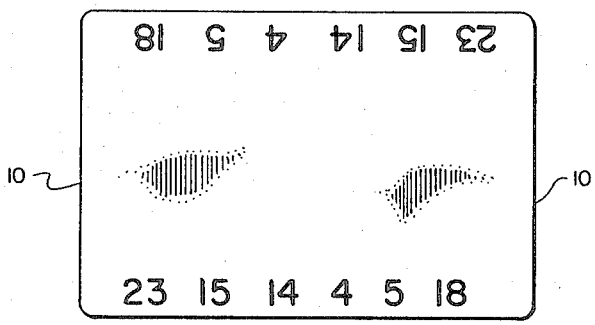
FIG. 2 is a view of the obverse face of the word card of FIG. 1 with a numerical representation of the word "WONDER" imprinted thereon.

The word card 10 shown in FIG. 1 has the word "WONDER" printed on its reverse face, the visible face as illustrated in FIG. 1. The word is preferably printed along opposite sides of the reverse face, so that the word can be read from either side of the card 10. In FIG. 2, the obverse side of the word card 10 is shown, with the numerical representation of the word "WONDER" imprinted thereon. The numerical representation is preferably printed along opposite sides of the obverse face, so that the numerical representation can be seen in proper order from either side of the card 10. The first letter of the word "WONDER" is "W" which is the 23rd letter of the alphabet. Thus, the first number in the numerical representation on the obverse face of word card 10 is the number "23". The second number is "15" corresponding to the 15th letter of the alphabet, namely "0". The third through sixth numbers are "14", "4", "5", and "18", respectively. These numbers correspond to the letters "N", "D", "E", and "R" which are the 14th, 4th, 5th, and 18th letters of the alphabet, respectively.

Figure 3:
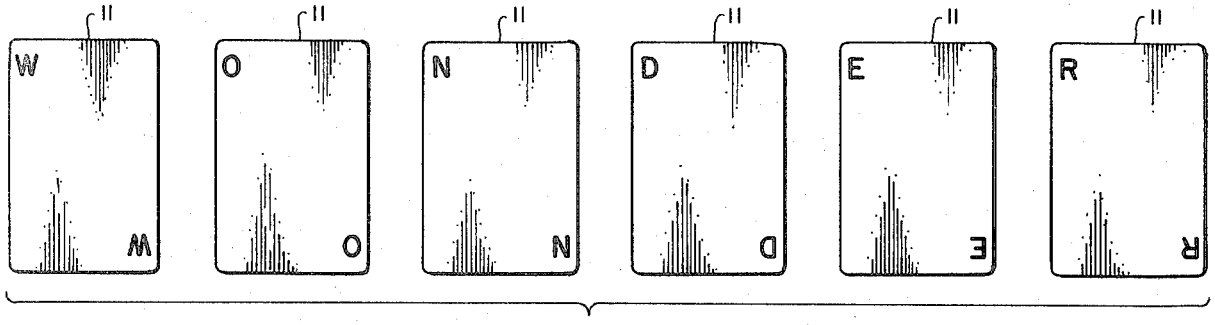
FIG. 3 is a view of six of the playing cards from the deck of the playing cards, with the cards having the letters of the word "WONDER" imprinted thereon.

In one aspect of the invention, a deck of playing cards is provided having individual letters of the alphabet printed on the obverse faces of the mutually respective cards. Six representative cards 11 from such a deck of playing cards are shown in FIG. 3. The reverse faces of the playing cards 11 in the deck of playing cards can be imprinted with a common design as is common with ordinary playing cards. As illustrated in FIG. 3, the obverse side of each playing card 11 has an alphabet letter printed thereon. As shown the six cards 11 have the letters "W", "O", "N", "D", "E", and "R" printed thereon respectively. The letters are advantageously printed in opposite corners of the cards 11, with the bottom of the letters toward the midsection of the cards 11.

The deck of playing cards to which the six representative cards 11 shown in FIG. 3 belong, preferably contain at least 52 cards. However, a deck of playing cards containing 26 cards can also be used. With the deck containing 52 cards, words can be formed which contain double letters, inasmuch as the deck of playing cards contains two cards for each letter in the alphabet. When playing with a deck of playing cards containing only 26 cards, words to be formed are restricted to those in which none of the letters therein are duplicates of each other, inasmuch as the deck of playing cards contains only one card for each letter of the alphabet.

In playing a preferred word game in accordance with the invention using a deck of playing cards having alphabet letters imprinted thereon, such as cards 11 of FIG. 3, and a deck of word cards containing word cards such as card 10 of FIGS. 1 and 2, one or more of the word cards are randomly selected from the deck of word cards and placed on a table, with their obverse faces exposed to view, i.e., with the numerical representations of the word of the respective word card being exposed. Playing cards are dealt from the deck of playing cards to the players, preferably such that all the playing cards are dealt out. The players study the exposed word card or cards and begin to play the playing cards from their hand in a pile adjacent to the word card. If the word card shown in FIG. 2 was being played upon, the players would study the first number, i.e., the number "23", then determine the 23rd letter in the alphabet or the letter "W". The player with a "W" in his playing cards then plays that card to start the pile upon which the remaining cards which are to be played for that word will be subsequently played. The players having a playing card with an "O" or the 15th letter of the alphabet then can play that card on top of the "W" card. Likewise, the cards containing an "N", "D", "E", and "R", corresponding to the 14th, 4th, and 5th, and 18th letters of the alphabet are played in order. The players then can call out the word which has been spelled to win that particular play. The player calling out the word lifts the word card to see if the called out word was correct. If it was not, the player replaces the word card to the table, and the remaining players may attempt to call out the correct word.

To increase the difficulty of the game, two or three word cards are played upon simultaneously, i.e., two or three word cards are randomly chosen from the deck of word cards and placed on the table with their obverse face upward. The players then play cards on separate piles one for each word card. Having more than one word card being played upon at a time increases the concentration and memory for each player. Many other variations of the word game using the deck of word cards and the deck of playing cards containing letters imprinted thereon are possible.

Figure 4:
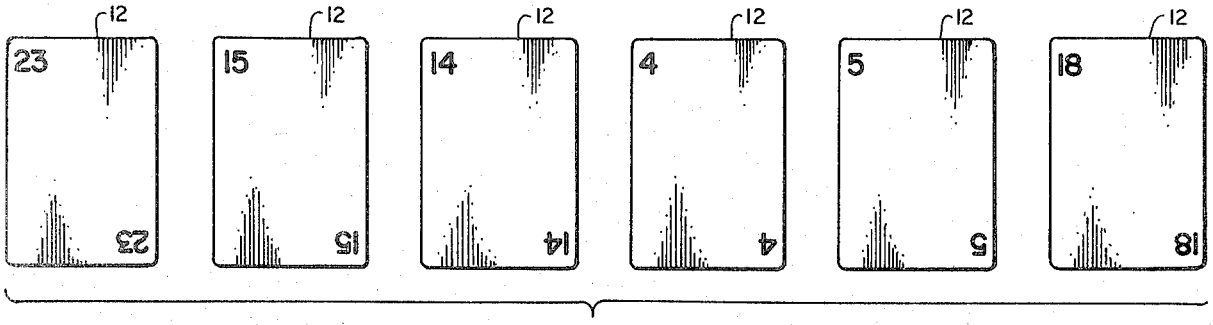
FIG. 4 is a view of six of the playing cards from a deck of playing cards having numbers imprinted thereon instead of letters, with the numbers corresponding to the letters in the word "WONDER".

In another aspect of the invention, the deck of playing cards contain numbers imprinted on the obverse face thereof instead of the letters of the alphabet. Six representative playing cards 12 from such a deck of playing cards are shown in FIG. 4. As shown, the six cards 12 have the numbers "23", "15", "14", "4", "5", and "18" printed thereon, respectively. The reverse faces of the cards 12 in the deck of playing cards having numbers printed thereon can be imprinted with a common design on the reverse faces as is common with ordinary playing cards. As shown, on the obverse face, the numbers are printed in opposite corners of the cards 12, with the bottom of the numbers toward the midsection of the cards 12. The numbers on the cards 12 correspond to a letter in the alphabet. There are at least 26 cards in the deck each containing a number from "1" to "26". Preferably, the deck of the numbered playing cards 12 will contain 52 cards, with two cards for each number between "1" and "26".

In playing a preferred word game in accordance with the invention using a deck of playing cards having numbers imprinted thereon, such as cards 12 of FIG. 4, and a deck of word cards containing word cards such as card 10 of FIGS. 1 and 2, one or more of the word cards are randomly selected from the deck of word cards and placed on a table, with their reverse faces exposed to view, i.e., with the spelled word on the card being exposed. Playing cards are dealt from the deck of playing cards to the players, preferably such that all the playing cards are dealt out. The players study the exposed word card or cards and begin to play the playing cards from their hand in a pile adjacent to the word card. If the word card shown in FIG. 1 was being played upon, the players would determine that the "W" was the 23rd letter in the alphabet. The player with a playing card having the number "23" then plays that card to start the pile upon which the remaining cards which are to be played for that word will be subsequently played. The player with a card number "15" for the 15th letter of the alphabet can play that card on top of the previous card which has a "23" therein. Likewise, the cards containing a "14", "4", "5" and "18" imprinted thereon are played in order. When the last card in the pile has been played, the players attempt to call out the correct sequence of numbers in the pile. The player calling out the sequence lifts the word card to see if the called out sequence was correct. If it was, that player wins that particular play. If the called out sequence was not correct, the player replaces the word card to the table, and the remaining players may attempt to call out the correct sequence.

To increase the difficulty of the game, two or three word cards can be played upon in the same manner as described hereinbefore with respect to the game in which playing cards having letters imprinted thereon are used. Many other variations of the word game using the deck of word cards and the deck of playing cards containing numbers imprinted thereon are possible.

It is noted that on the obverse face of the word cards such as card 10 shown in FIG. 2, the numbers representing the letters of the word for that card are separated from each other by appropriate marking, coloring or other means. The colors of the numbers could be varied or alternated. Thus the "23" could be in red, the "15" in black, the "14" in red, the "4" in black, the "5" in red, and the "18" in black. Advantageously, the numbers can be separated by a space and a marking therebetween such as the dots shown in the card 10 of FIG. 2.

Although preferred embodiments of the invention have been illustrated and described, it is to be understood that the present disclosure is made by way of example and that various other embodiments are possible without departing from the subject matter coming within the scope of the following claims, which subject matter is regarded as the invention.

I claim:

1. A spelling, counting and memory game comprising at least one word card which has a word imprinted on the reverse face of said word card and a numerical representation of that word on the obverse face of said word card, with the numerical representation being formed by a set of numbers in which each number represents a letter of the alphabet as determined by the numerical arrangement of the letters in the alphabet; and a plurality of playing cards in which indicia corresponding to the letters of the alphabet or numbers representing letters of the alphabet are printed on said playing cards, so that each of said playing cards represents one of the letters of the alphabet.

2. A spelling, memory game as claimed in claim 1, wherein a plurality of word cards are provided in a deck, and word cards are randomly drawn from the deck.

3. A spelling memory game as claimed in claim 1, wherein the plurality of playing cards are letter cards having the letters of the alphabet printed on said letter cards, so that each of said letter cards represents one of the letters of the alphabet and has that representative letter printed thereon.

4. A spelling memory game as claimed in claim 1, wherein the plurality of playing cards are number cards having numbers representing the letter of the alphabet printed on said number cards, so that each of said number cards represents one of the letters of the alphabet and has the number corresponding to that letter printed thereon.

* * * * *